US005390798A

United States Patent [19]

Yanuzzi

[11] Patent Number: 5,390,798

[45] Date of Patent: * Feb. 21, 1995

[54] FOOD AND BEVERAGE SUPPORT TRAY WITH BEVERAGE VESSEL CUTOUT

[75] Inventor: Gerard Yanuzzi, Raritan Township, Somerset County, N.J.

[73] Assignee: G'-Ka International, Inc., Revere, Pa.

[ * ] Notice: The portion of the term of this patent subsequent to Mar. 15, 2011 has been disclaimed.

[21] Appl. No.: 176,083

[22] Filed: Dec. 30, 1993

Related U.S. Application Data

[63] Continuation-in-part of Ser. No. 788,887, Nov. 7, 1991, Pat. No. 5,294,000.

[51] Int. Cl.[6] ..... B65D 1/34; B65D 21/00

[52] U.S. Cl. ..... 206/562; 206/519; 206/557; 220/238; 220/575; 220/914

[58] Field of Search ..... 206/557, 562, 563, 564, 206/565, 519; 220/23.8, 23.83, 574, 575, 912; D7/543, 545, 546, 549, 550, 553, 554

[56] References Cited

U.S. PATENT DOCUMENTS

| | | | |
|---|---|---|---|
| D. 54,971 | 4/1920 | Thompson | D7/554 |
| D. 173,944 | 2/1955 | Harris | D7/554 |
| D. 182,396 | 4/1958 | Berry, Jr. | D7/549 |
| D. 194,114 | 11/1962 | Graham | D7/549 |
| D. 293,190 | 12/1987 | Flanagan, Sr. | D7/553 |
| D. 296,404 | 6/1988 | Lowenbein | D7/553 |
| D. 305,192 | 12/1989 | van Ertel | D7/553 X |
| D. 308,461 | 6/1990 | Hosea | D7/549 |
| 1,885,483 | 11/1832 | Samuelson | 206/564 X |
| 2,704,974 | 3/1955 | Setman | 206/519 X |
| 4,219,144 | 8/1980 | Hagelberg . | |
| 4,461,396 | 7/1984 | Harper | 220/23.83 |
| 4,516,685 | 5/1985 | French . | |
| 4,966,297 | 10/1990 | Doty | 220/23.83 |
| 4,991,713 | 2/1991 | Phillips . | |
| 5,294,000 | 3/1994 | Yaruzzi | 206/562 |

FOREIGN PATENT DOCUMENTS

| | | | |
|---|---|---|---|
| 255643 | 7/1926 | United Kingdom | 220/23.8 |
| 266528 | 3/1927 | United Kingdom | 220/23.8 |
| 1126304 | 9/1968 | United Kingdom | D7/549 X |
| 2118430 | 11/1983 | United Kingdom | 220/575 |

*Primary Examiner*—Bryon P. Gehman
*Attorney, Agent, or Firm*—Kenneth P. Glynn

[57] ABSTRACT

The present tray has a base with an imaginary center line running from front to back and evenly distanced from the left and right sides. There is a first orifice through the top of the base biased to one side of the center line. This orifice is adapted to receive a beverage vessel and includes a cutout running from the side of the base to the first orifice to permit lateral insertion of a beverage vessel into the first orifice. There is a second orifice through the top of the base which is circular in shape and biased toward one side of the center line opposite the first orifice. The second orifice is adapted to receive a food plate. There is a first notch located on the top of the base on the front of the base near the center line. This notch is adapted to receive an area between a thumb and a first finger of a user. There is a second notch which is similar and located on the top of the base on the back of the base near the center line. The first and second notches are located opposite one another along the center line.

15 Claims, 2 Drawing Sheets

FOOD AND BEVERAGE SUPPORT TRAY WITH BEVERAGE VESSEL CUTOUT

REFERENCE TO RELATED CASE

This application is a continuation-in-part of U.S. patent application Ser. No. 07/788,887, filed on Nov. 7, 1991, now U.S. Pat. No. 5,294,000, and entitled "Food and Beverage Support Tray", by the inventor herein.

BACKGROUND OF THE INVENTION

1. Field of the Invention

The present invention involves a support tray for food and beverages. It is a tray specifically adapted to hold both a plate and a beverage container, e.g. wine glass, coffee cup, glass, in a weight distributed fashion. The present invention tray has left hand and right hand holding adaptations as well as a beverage vessel cutout, and may be permanent china, plastic ware or disposable.

2. Prior Art Statement

Trays have been utilized for centuries for carrying dishes, serving bowls, etc., and, in modern times, for many purposes including fast food service, party foods, cafeteria service, and the like. Specialty trays have more recently been developed for compartmentalizing the tray and for carrying specific items.

U.S. Pat. No. 4,2 19,144 issued to Gabriella Hagelberg describes a serving tray with a number of recesses in the form of bowls for components of a meal. A recess is provided for at least one dish and one is provided for a drinking vessel. A hole extends through Hagelberg's tray in a shape and size to form an opening for the insertion of the thumb of a hand so that the tray can be carried with the thumb on the upper side of the tray while the hand is placed under the tray bottom to support the underside of the tray. However, the thumb hole is in a corner to allow the hand to go under the tray and is not balanced at all. It also has no holes for the beverage vessel and thus it is top heavy and easily tipped during use. Finally, it is not left hand/right hand symmetrical.

U.S. Pat. No. 4,516,685 to Michael French sets forth a plate-type tray with a tapered plate section and a recess for receiving a drinking vessel. No provision is made for carrying a separate plate therein nor is there a provision for a thumb recess nor is there right hand/left hand interchangeability.

More recently U.S. Pat. No. 4,991,713 to Fredrick Phillips describes a serving tray with deep recesses for drinking vessels but does not address the other prior art shortcomings set forth above.

Thus, the prior art describes various specialty trays but none providing orifices for both dishes and beverage containers coupled with dual thumb recesses opposed to one another to provide balance and left hand/-right hand reversibility or interchangeability.

SUMMARY OF THE INVENTION

The present invention is a tray for supporting food plates and beverage vessels. It comprises a base structure which is substantially flat and has a front and a back, a left side and a right side, and has a top and a bottom. It has an imaginary center line running from front to back and evenly distanced from said left side and right side. There is a first orifice through the top of the base being circular in shape and being biased to one side of said center line. This orifice is adapted to receive a beverage vessel. It includes a beverage vessel cutout for lateral insertion of a beverage vessel. There is a second orifice through the top of the base which is circular in shape and is biased toward one side of said center line opposite said first orifice. This second orifice is adapted to receive a food plate. There is a first notch located on the top of said base on the front of said base near said center line. This notch is adapted to receive an area between a thumb and a first finger when being held with the thumb on the top of said base and fingers on the bottom of said base. There is also a second notch located on the top of said base on the back of said base near said center line, said notch being adapted to receive an area between a thumb and a first finger when being held with the thumb on the top of said base and fingers on the bottom of said base. The first notch and the second notch are located opposite one another along the center line. In a preferred embodiment, the second orifice has a surrounding recess tapered to receive an outer rim of a plate.

BRIEF DESCRIPTION OF THE DRAWINGS

The present invention is more clearly understood when the specification herein is taken in conjunction with the drawings appended hereto, wherein.

DETAILED DESCRIPTION OF THE INVENTION

In many social situations such as wedding receptions, cocktail parties, cook-outs, graduation parties, banquets, buffets and other stand up/dining/social situations, people are confronted with having to hold plates or dishes in one hand, and eat, hold glasses or cups and greet and shake hands with the other hand. This is an awkward task at best and often results in less eating, greeting, etc., than one would like.

The present invention is directed to a specialty tray to alleviate the problems described as well as to provide other unique features.

Thus, it is an object of present invention to provide a tray for receiving both plates and beverage vessels in a non-top heavy fashion. It is also an object of the present invention to provide a tray which is left hand/right hand reversible and which is somewhat balanced regardless of whether it is used by a left handed or right handed person. It is also an object to create a new piece of permanent china, and, in the alternative, functional yet fashionable permanent or disposable non-china products.

Figure 1:
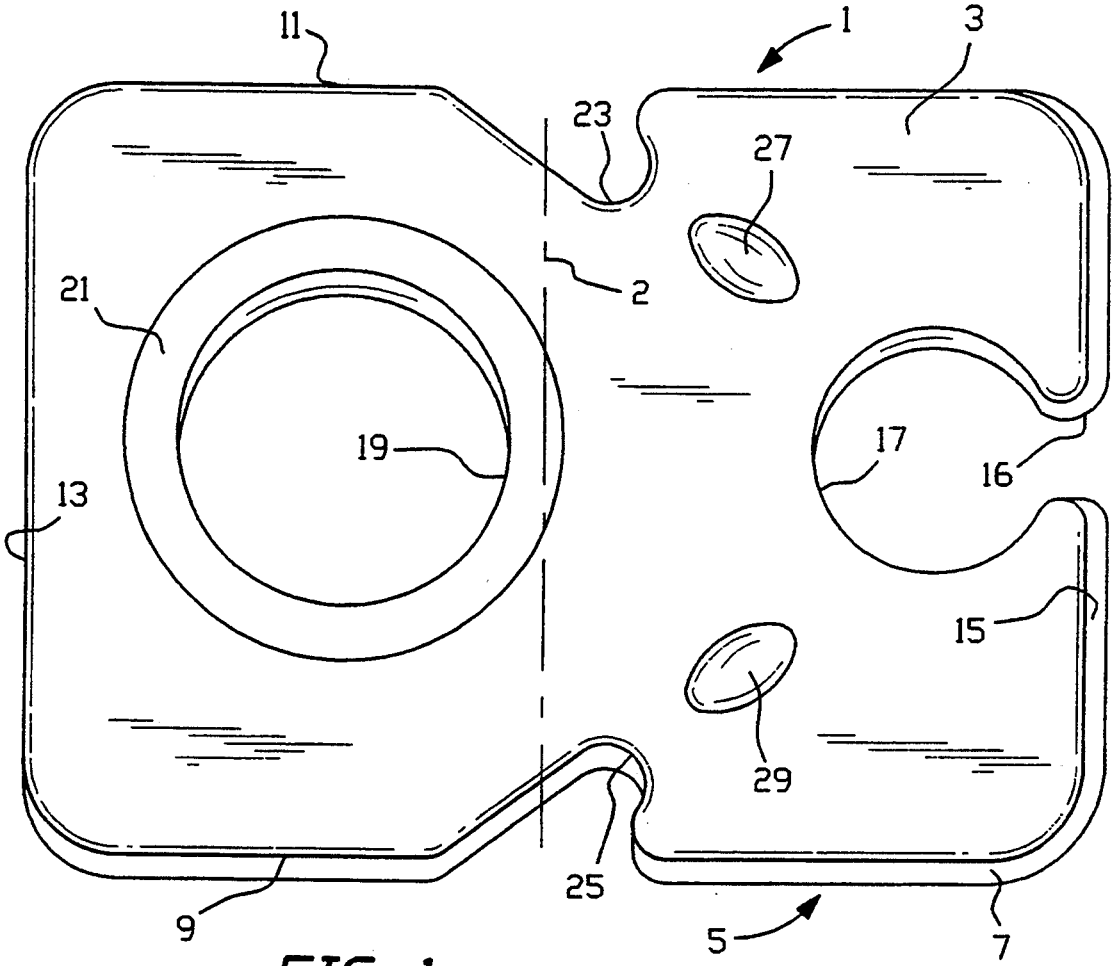
FIG. 1 shows a top oblique view of a tray of the present invention.

Referring now to FIG. 1, there is shown a top oblique view of a present invention tray 1 for supporting food plates and beverage vessels. A base structure is unistructurally formed in its preferred embodiments and includes top 3, bottom 5, left side 13, right side 15, front 9 and back 11. Imaginary center line 2 is shown running from front 9 to back 11 and evenly distanced from said left side 13 and right side 15.

A first orifice 17 is circular in shape and includes a beverage vessel cutout 16. It is adapted to receive a beverage vessel, such as a cup, glass, mug, etc., and is typically about 2 to 3 inches in diameter, although this is merely exemplary. The exact diameter should be in the range of diameters adequate to receive typical vessel diameters, e.g. a tapered glass midway up its height. This first orifice 17, as can be seen, is biased to one side of the center line 2. The cutout 16 enables a user to place a beverage vessel, e.g. a stemmed glass, into orifice 17 by lateral movement, i.e. sideways rather than through the top, and this permits larger based vessels to be supported, and makes usage more convenient.

A second orifice 19 is made through the top 3 of tray 1 and is generally circular in shape and is biased to the opposite side of center line 2 from orifice 17. This second orifice 19 is adapted to receive a food plate with the base of such a plate nesting within orifice 19. Optional tapered recess 21 is included to approximate the taper of a typical plate and when such a plate nests therein, its tapered rim rests on recess 21. This second orifice 19 may be about 5 to about 8 inches in diameter and a typical plate base would fit well into an orifice having a diameter of about 7 inches.

While the orifices described herein are stated as being "circular" this should be broadly taken to mean a configuration which encompasses more than half of a plate or beverage vessel to hold it. For example, orifice 17 is described as circular but it does not encompass a complete circle. It could even be comprised of a series of evenly angled straight edges, such as an octagon and yet still be adequately circular to be included herein.

The tray 1 shown in FIG. 1 may be constructed of china, fine china, thermoset plastic, heat-resistant glass, glass, thermoplastic, blown plastic, such as styrofoam, cardboard, plastic-coated cardboard, metal such as stainless steel, silverware or aluminum, or any other material used for tableware or disposable products.

It can now be seen that the tray 1 of FIG. 1 has first thumb notch 23 and second thumb notch 25 formed along center line 2 with both notches facing right side 15 (they could, alternatively, both face left side 13). During use, the tray is held in the left hand with the base of the thumb into notch 25 with the thumb resting on recess 29. The tray 1 may be reversed so that back 11 faces the user and a right hand thumb base is placed in notch 23 with the thumb in recess 27 and the rest of the hand on bottom 5. The tray 1 is left hand/right hand reversible and is balanced so that a plate nests in orifice 19 and a beverage vessel may be laterally inserted into and nests in orifice 17 for a relatively balanced usage with a plate to the left of the hand and a beverage vessel to the right of the hand.

Figure 2:
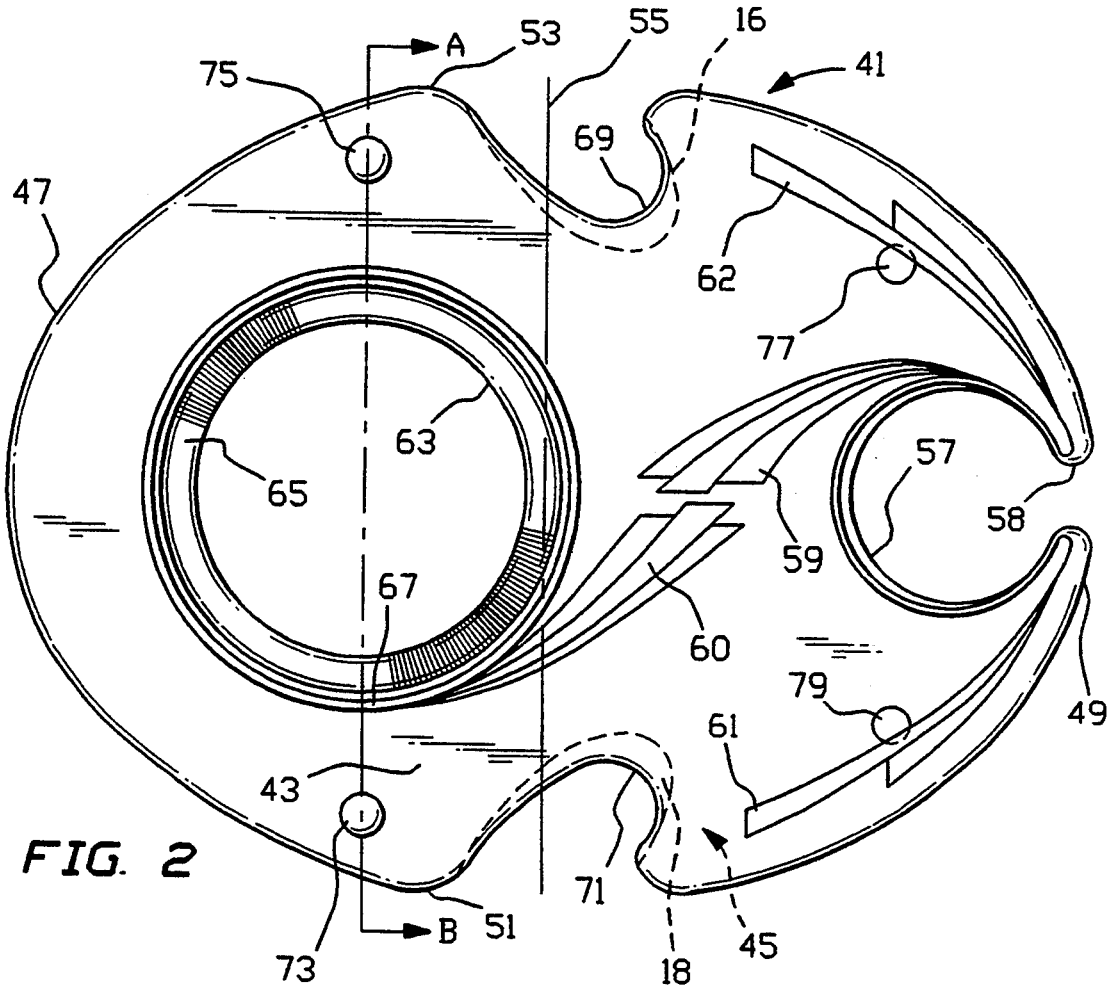
FIG. 2 is a top view of an alternative embodiment tray of the present invention; and, FIG. 3 shows a side cut view of the present invention tray shown in FIG. 2.

FIG. 2 shows a top view of an alternative embodiment tray 41. Here, tray 41 is more modernistic in its overall oval shape and curvilinear structure. Referring to both FIGS. 2 and 3, tray 41 has a front 51, back 53, left side 47 and right side 49, as well as top 43 and bottom 45. In this embodiment, imaginary center line 55 has first orifice 57 to its right and second orifice 63 to its left. Orifice 57 is open to end 49 at cutout 58 and is adapted to receive a drinking vessel. Orifice 63 includes tapered recess 65 and flat rim 67, as shown. Decorative reliefs 59, 60, 61 and 62 are included. Further, stack spacing nodes 73, 75, 77 and 79 are included so that when trays such as tray 41 are stacked, they will be spaced apart from one another to enhance drying upon cleaning as well as to provide easier access for the user. These nodes should preferably be in pairs. For example, the rim 67 may act as a stacking spacer, given enough elevation, and only two nodes would be needed for good stacking. Also, two or four such nodes, for example, may be included on bottom 45 of tray 41. As discussed in conjunction with the FIG. 1 embodiment above, orifice 63 and tapered recess 65 are adapted to receive plates and dishes of similar geometry.

First notch 69 and second notch 71 are used in a similar fashion to notches 23 land 25 shown in FIG. 1. However, in this embodiment, tapered portions 16 and 18 are included on bottom 45 to provide for a more comfortable "sit and feel" and ease of handling.

Figure 3:
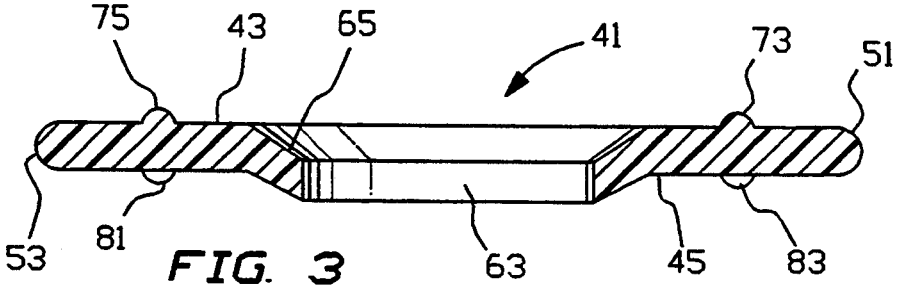

FIG. 3 shows a side cut view of tray 41 taken from left side 47 of FIG. 2 along line AB. As can be seen, orifice 63 is set downwardly from top 43 and tapered recess 65 is as shown. Optional nodes 81 and 83 are located on the opposite side from nodes 73, 75, 77 and 79 to aid in separation of the trays during stacking.

Obviously, numerous modifications and variations of the present invention are possible in light of the above teachings. It is therefore understood that within the scope of the appended claims, the invention may be practiced otherwise than as specifically described herein.

What is claimed is:

1. A tray for supporting food plates and beverage vessels, which comprises:

(a) a base structure being substantially flat and having a front and a back, a left side and a right side, and having a top and a bottom, and having an imaginary center line running from front to back and evenly distanced from said left side and right side;

(b) a first orifice through the top of said base being circular in shape and being biased to one side of said center line, said orifice adapted to receive a beverage vessel, said base also including a beverage vessel cutout, extending from the side of said base structure into said first orifice so as to permit lateral insertion of a beverage vessel into said first orifice;

(c) a second orifice through the top of said base and being circular in shape and being biased toward one side of said center line opposite said first orifice, said second orifice being adapted to receive a food plate;

(d) a first notch located on the top of said base on the front of said base near said center line, said notch being adapted to receive an area of a hand of a user between a thumb and a first finger when being held with the thumb on the top of said base and fingers on the bottom of said base; and, (e) a second notch located on the top of said base on the back of said base near said center line, said notch being adapted to receive an area of a hand of a user between a thumb and a first finger when being held with the thumb on the top of said base and fingers on the bottom of said base;

wherein said first notch and said second notch are located opposite one another along said center line.

2. The tray of claim 1, wherein said second orifice has a surrounding recess tapered to receive an outer rim of a plate.

3. The tray of claim 1, wherein said top of said tray further includes two thumb recesses, one located near each of said first and second notches.

4. The tray of claim 1, wherein said tray further includes at least two stack spacing nodes on its top surface.

5. The tray of claim 4, wherein said tray further includes at least four stack spacing nodes on its top surface.

6. The tray of claim 1, wherein said tray further includes at least two stack spacing nodes on its bottom surface.

7. The tray of claim 6, wherein said tray further includes at least four stack spacing nodes on its bottom surface.

8. The tray of claim 1 further includes a tapering of said first and second notches on the bottom of said tray for ease of holding.

9. The tray of claim 8, wherein said second orifice has a surrounding recess tapered to receive an outer rim of a plate.

10. The tray of claim 8, wherein said top of said tray further includes two thumb recesses, one located near each of said first and second notches.

11. The tray of claim 1, wherein said tray is made of china.

12. The tray of claim 1, wherein said tray is made of plastic.

13. The tray of claim 1, wherein said tray is made of metal.

14. The tray of claim 1, wherein said tray is made of molded paper.

15. The tray of claim 1, wherein said tray is made of styrofoam.

* * * * *